US005729202A

United States Patent [19]

Klaehn

[11] Patent Number: 5,729,202

[45] Date of Patent: Mar. 17, 1998

[54] ELECTRONIC ARTICLE-SURVEILLANCE APPARATUS AND METHOD OF OPERATING SAME

[76] Inventor: David P. Klaehn, 104 Three Valleys Drive, Don Mills, Ontario, Canada, M3A 3B9

[21] Appl. No.: 701,758

[22] Filed: Aug. 22, 1996

Related U.S. Application Data

[60] Provisional application No. 60/002,706, Aug. 23, 1995.

[51] Int. Cl. [6] ..... G08B 13/14

[52] U.S. Cl. ..... 340/572; 340/551; 340/552

[58] Field of Search ..... 340/572, 551, 340/552, 568, 571

[56] References Cited

U.S. PATENT DOCUMENTS

| | | | |
|---|---|---|---|
| 3,810,147 | 5/1974 | Lichtblau . | |
| 3,838,409 | 9/1974 | Minasy et al. . | |
| 4,139,844 | 2/1979 | Reeder | 340/572 |
| 4,274,089 | 6/1981 | Giles | 340/572 |
| 4,309,697 | 1/1982 | Weaver . | |
| 4,531,117 | 7/1985 | Nourse et al. | 340/572 |
| 4,622,542 | 11/1986 | Weaver | 340/572 |
| 4,622,543 | 11/1986 | Anderson . | |
| 5,353,010 | 10/1994 | Sanetra | 340/572 |

*Primary Examiner*—Thomas Mullen
*Assistant Examiner*—Nina Toug
*Attorney, Agent, or Firm*—Shoemaker and Mattare, Ltd

[57] ABSTRACT

In order to detect the presence of a marker, an electronic article-surveillance apparatus includes a transmitting circuit coupled to a transmit antenna, a receiving antenna juxtaposed with respect to the transmit antenna, such that an electromagnetic signal is generated within a controlled area, the signal being received by the receiving antenna, such that when the marker is located within the controlled area, a disturbance is created in said electromagnetic signal and is picked up by the receiving antenna. The disturbance is the marker signal. An electronics module receives the electromagnetic signal picked up by the receiving antenna, and a feedback conduit, linking the electronics module with the transmitting circuit, can provide to the electronics module an input to the transmitting circuit which controls the amplitude of the electromagnetic signal so as to maintain the marker signal at a substantially constant amplitude and shape. A detection module receives the marker signal and can analyze the marker signal in accordance with predetermined criteria. An alarm circuit is actuated by the detection module when the latter confirms the presence of the marker signal in accordance with the predetermined criteria.

14 Claims, 2 Drawing Sheets

ELECTRONIC ARTICLE-SURVEILLANCE APPARATUS AND METHOD OF OPERATING SAME

This application is a provisional of application Ser. No. 60/002,706 filed Aug. 23, 1995, now abandoned.

This invention related to electronic security systems which use some kind of marker such as a strip of highly permeable magnetic material, a resonant circuit, a ferroresonant marker, a microwave diode, etc., activated within an interrogation zone. The electronic detection of the marker within the interrogation zone is employed to control the passage of articles through it.

BACKGROUND OF THE INVENTION

Over the years, may electronic article surveillance or anti-shoplifting systems have been devised for detecting the unauthorized removal of articles from an area under protection. Some of these are described in U.S. patents by Lichtblau 3,810,147, Minasy 3,838,409, Weaver 4,309,697, Anderson 4,622,543, and others. While these inventions differ in many details such as the frequency of operation, the type of marker, the particular detection schemes used, etc., they have certain fundamental features in common.

All electronic articles surveillance systems generally create an electromagnetic field within a limited space called an interrogation zone through which the articles to be protected must pass. Attached to the protected articles is a specific element called a marker. The marker is designed to interact in a particular way with the electromagnetic interrogation field to create a signal that is unique to this system. In a preferred design, this so called marker signal is such that its presence can be detected by circuitry located in the electronic article surveillance system. This circuitry continually scans the interrogation zone looking for the marker signal and generates an alarm when one is found.

The key to the success of these systems lies in the ability of the marker to create a strong, unique, reproducible and constant marker signal when encountering the electromagnetic field. For reasons that will be discussed later, the marker signal is not always unique or constant. Therefore, the system for detecting the marker signal must be able to recognize a range of acceptable marker signals. A great deal of effort goes into optimization of the system and marker to produce this signal while trying to ensure that other objects will into produce a similar result While the usefulness of these systems is high, the are plagued by two problems. On one hand, their effectiveness is limited by the presence of items which, under certain circumstances, will behave like a marker and create a signal that is similar in some ways. When this similar signal is accepted by the electronic article surveillance system, it is called a false alarm because it is not created by the true marker. In most designs of electronic article surveillance systems, the detection circuitry must either accept some false alarms in order to guarantee the detection of all true alarms or, by narrowing the acceptance criteria for the marker signal sufficiently to reject all false alarms, reject some true alarms. Or a compromise solution may be selected. In an event, false alarms will be a problem and/or system sensitivity will be reduced.

A second set of problems in electronic article surveillance system results from variations into the marker signal due to:

a) variations in the strength of the electromagnetic field within the interrogation zone;

b) the variability of the interaction of the transmitted field with the marker; and c) variations in the characteristics of the marker itself due to manufacturing limitations, etc. Typically, the transmitting field is generated by one or more antennas in such a manner that the strength of the field varies throughout the interrogation zone. Consequently, the placement of the marker with respect to the transmitting antenna will affect the marker signal. In addition, the strength of the marker signal varies with the orientation of the marker with respect to the transmitted field, die to differences in coupling. Finally, markers will vary from each other in some small way due to manufacturing tolerances. This is particularly a concern in system which use resonant circuit technology. Usually, variations in the properties of the marker are permitted and accommodated by the design and implementation of the detection method of the electronic article surveillance system.

Therefore, in practice, an acceptable or true marker signal may have a variety of defining characteristics, such as amplitude, shape, statistical properties, frequency properties, duration, etc. If it is decided to broaden the definition of the acceptable marker signal to account for the numerous possibilities, this opens the door to the acceptance of undesirable signals created by other items. The converse is also undesirable as it leads to lower sensitivity. No system currently available has satisfactorily solved this problem.

SUMMARY OF INVENTION

In accordance with the present invention, a method of improving the performance of electronic article surveillance systems is provided which is able to substantially control the operating environment in the interrogation zone and create a marker signal that is for the most part constant and independent of the position and orientation of the marker within the transmitted field and of variations in the marker itself. This control is effected because the system is able to compare the observed marker signal or one or more defining characteristics thereof with a stored reference and use the differences to vary the characteristics of the transmitted field, such as amplitude, frequency, phase, duration, or other similar defining properties, in such a way that the marker signal remains unchanged even as the marker moves through the interrogation zone.

One particular embodiment of this invention is useful in an electromagnetic electronic article surveillance system, a system which uses a highly permeable, low coercivity strip of metal as the marker. When this marker interacts with an electromagnetic filed of the appropriate frequency, a series of harmonic components are generated. This invention monitors a particular defining characteristic of the marker signal such as the amplitude of one or more of the harmonic components. This information is continually collected and compared to a reference level such that any differences result in an error signal. This error signal is then used to control the strength of the transmitted field in order to maintain the amplitude of the harmonic component at the selected level. By this method, the marker signal can be maintained in a constant state.

During the operation of this invention, when no marker is present in an interrogation zone, no marker signal and no harmonic is observed and a large error signal is present. As a result, the transmitted field is set to maximum amplitude or power in order to maintain the system at maximum sensitivity. This condition is maintained until a marker appears and generated a harmonic. As the amplitude of the harmonic component approaches that of the reference, the error signal decreases until a lock condition is achieved at minimum error. Whenever the amplitude of the harmonic component begins to vary from that of the reference level, an error signal is generated. This error signal causes the strength of the transmitted field either to increase or to decrease until the amplitude of the harmonic component returns to the reference value. In this manner, the strength of the transmitted field is continually adjusted to maintain a constant amplitude of the harmonic component and hence an essentially constant marker signal.

Another embodiment of this invention would be useful in an electronic article system that employs resonant circuits. In some designs of this type of system, the frequency is swept or varied over a range of values until a signal representing the interaction of the marker and the transmitted frequency is found. Sweeping is necessary because of variations in the resonant frequency of the resonant circuit. Maximium sensitivity can only be achieved when the transmitter frequency matches the resonant frequency of the resonant circuit. This invention can be used to control the frequency as well as the amplitude of the transmitted field, thereby providing a means to constantly control the interaction between the marker and the transmitted field and thereby maintain a constant marker signal.

It should be noted that the usefulness of this method is not limited to the above examples. It can be shown that this invention can provide similar advantages to other electronic article surveillance systems that employ microwave diodes to magnetomechanical or ferroresonant markers.

Other possible information related to the marker signal such as amplitude and phase information or statistical information or averaged values of the marker signal or its components or any other defining characteristics may also be used for this purpose.

With this control circuit operating, the alarm detection circuitry may be set to accept a narrower range of marker signal values than is normally possible. Once again amplitude and phase information or statistical or time averaged information related to the marker signal or its harmonic components may be employed.

The effect of objects or signals which normally interfere with electronic article surveillance systems is greatly diminished by this mode of operation. First, the criteria for marker signal acceptance are not much more restrictive with no significant loss in sensitivity. Secondly, in the presence of a strong marker signal, the transmitted field strength is reduced and thereby reduces the interference caused by other objects that sometimes mimic marker signals.

Finally, it should be noted that the above invention will have no effect upon the system performance if no marker is present and will have a more limited effect upon the performance of the system until the marker signal reaches a threshold level. When the marker first comes into contact with the transmitted field, the marker signal may be too small to trigger an alarm or activate this invention. A minimum value of marker signal, defined by the system design, must be reached before the control system as defined by this invention is fully operational.

More particularly, this invention provides, for detecting the presence of a marker having low coercivity and high permeability, an electronic article-surveillance apparatus comprising:

a transmitting circuit;

a transmit antennae coupled to said transmitting circuit;

a receiving antenna in operative juxtaposition with respect to the transmit antenna, whereby the transmit antenna under the control of the transmitting circuit can generate, within a controlled area, an electromagnetic signal which is received by the receiving antenna, such that when the marker is located within said controlled area, a disturbance is create din said electromagnetic signal and is picked up by the receiving antenna, the disturbance being the marker signal;

an electronics module receiving the electromagnetic signal picked up by the receiving antenna;

a feedback conduit linking the electronics module with the transmitting circuit, by which the electronics module can provide an input to the transmitting circuit which controls the amplitude of said electromagnetic signal in such a way as to maintain the marker signal at a substantially constant amplitude and shape;

a detection module connected so as to receive said marker signal, said detection module being adapted to analyze the marker signal in accordance with predetermined criteria;

and an alarm circuit connected so as to be actuated by said detection module when the detection module confirms the presence of the marker signal in accordance with said predetermined criteria.

Further, this invention provides, a method for detecting the presence of a marker having low coercivity and high permeability, comprising the steps:

using a transmitting circuit to generate an electromagnetic signal, and passing said signal to a transmit antenna coupled to said transmitting circuit;

receiving said electromagnetic signal in a receiving antenna disposed in operative juxtaposition with respect to the transmit antenna, whereby when the marker is located within a controlled area defined by said antennas, a disturbance is created in said electromagnetic signal and is picked up by the receiving antenna, the disturbance being the marker signal;

passing to an electronics module the electromagnetic signal picked up by the receiving antenna;

using a feedback conduit linking the electronics module with the transmitting circuit to provide an input to the transmitting circuit which controls the amplitude of said electromagnetic signal in such a way as to maintain the marker signal at a substantially constant amplitude and shape;

connecting a detection module to receive said marker signal, and using said detection module to analyze the marker signal in accordance with predetermined criteria;

and causing an alarm circuit to be actuated by said detection module when the detection module confirms the presence of the marker signal in accordance with said predetermined criteria.

DETAILED DESCRIPTION OF THE INVENTION

Figures 1, 2:
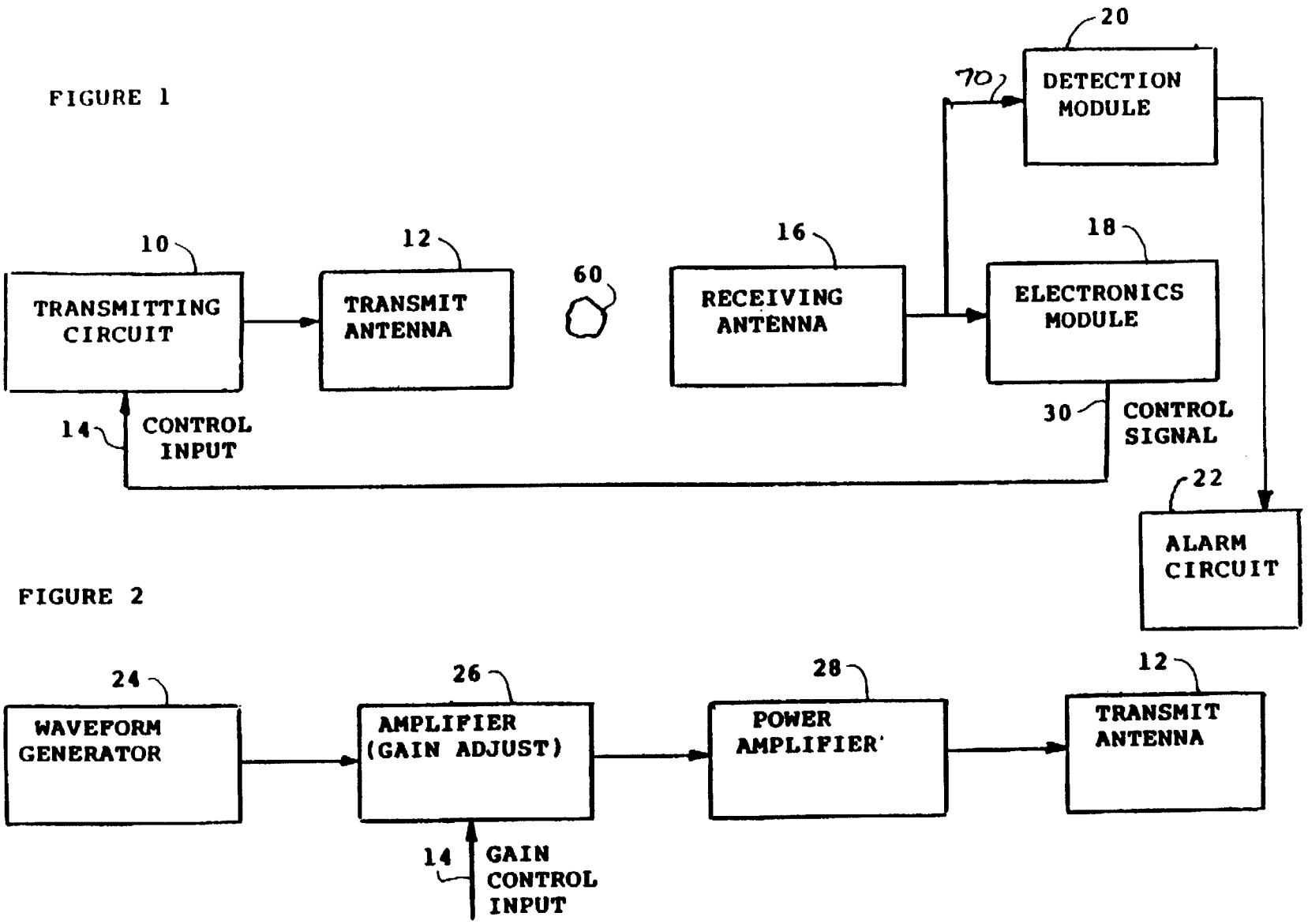
FIG. 1 is a block diagram representation of a security system employing the novel features according to the invention.
FIG. 2 is a block diagram representation of the transmitting circuit of FIG. 1.

An electronic article surveillance system that uses a magnetic strip of low coercivity an high permeability and employing the novel features according to the invention is depicted in block diagram form in FIG. 1. It includes an electronic transmitting circuit 10 coupled to a transmit antenna 12, typically but not necessarily a loop antenna, which establishes an electromagnetic field within a controlled area. The transmitting circuit is constructed with a control input 14 to permit external control of the amplitude of the transmitted field. A marker 60 when placed in the controlled area will cause a disturbance in the transmission from the transmit antenna 12 to a receiving antenna 16. This is called the marker signal 70. The receiving antenna 16, also typically but not necessarily a loop antenna, is arranged at the controlled area to receive the marker signal 70 and to couple it to an electronics module 18. The electronics module 18 generates a control signal 20 that is used to adjust the amplitude of the transmitted field so as to maintain the marker signal 70 at a substantially constant amplitude and shape. The detection module 20 analyzes the marker signal 70 according to predetermined criteria and actuates the alarm circuit 22.

The transmitting circuit 10 is illustrated in greater detail in FIG. 2. It includes a waveform generator 24, typically but not exclusively a sine wave oscillator that can be varied in frequency. The output of the waveform generator 24 goes to a gain stage 26 that, under the control of the external signal 30 applied to the gain control input 14 and generated by the electronics module 18, can adjust the amplitude of the output waveform, over a large dynamic range with low distortion. The output from the gain stage 26 is fed to a power amplifier 28 that provides the necessary power to drive the transmit antenna 12.

Figure 3:
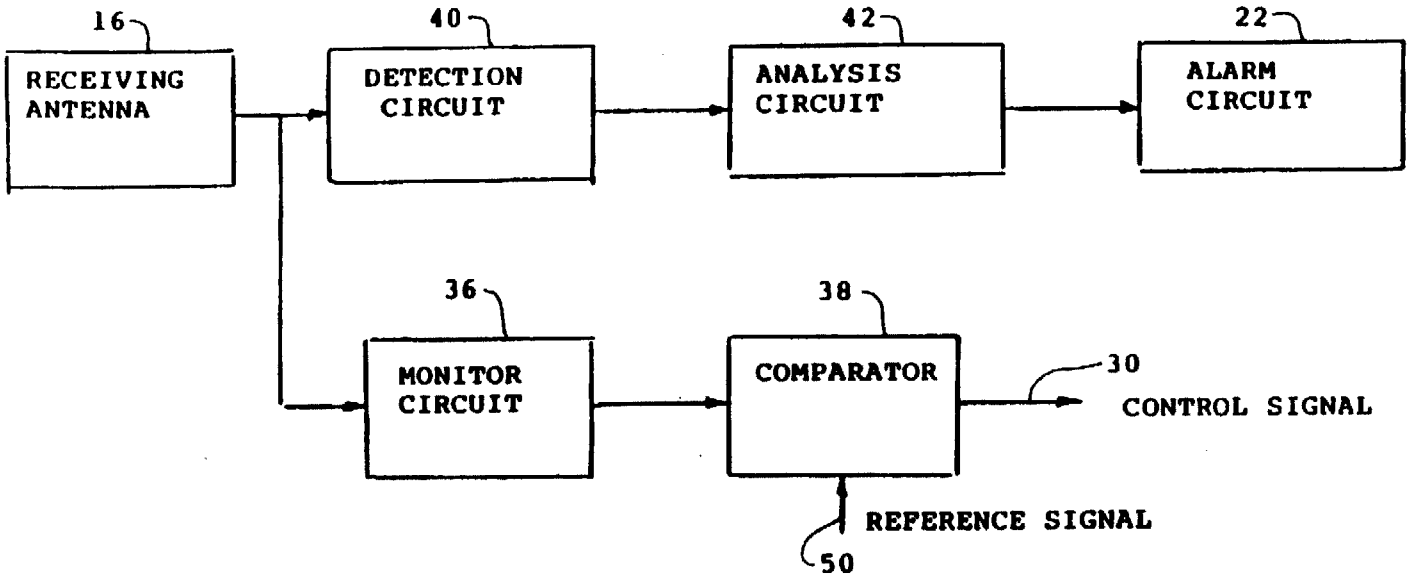
FIG. 3 is a block diagram representation of the receiver and control circuit of FIG. 1.

The receiver and control circuit is illustrated in greater detail in FIG. 3. It includes the receiving antenna 16 whose output is fed to a monitor circuit 36 which monitors selected components of the marker signal 70 and in comparator 38 compares these to a reference signal 75. Any error is used to generate a control signal 30 that will adjust the amplitude of the transmitted field which will in turn keep the marker signal 70 at the desired level. The output from the receiving antenna 16 is also brought to a detection circuit 40 which isolates and measures certain desired characteristics of the marker signal 70. This information is then passed on to the analysis circuit 42. If the correct marker signal characteristics are present, alarm generator 22 is activated.

the operation of the system can best be described as follows. Under normal operation, the system is in the hunting mode. With no marker 60 present, the output of the monitoring circuit 36 is at a minimum. Thus, the error signal is large and the control signal 30 is at a level to set the transmitted waveform 72 to its maximum amplitude. When a marker 60 appears in the controlled area, the monitor circuit will detect its presence. Nothing will happen until the amplitude of the marker signal 70 reaches the reference value. As that point is passed, the error signal will now begin to decrease the level of the transmitted field 72. Before the marker signal is able to change to a non-acceptable amplitude, the transmitted field will have changed to bring it back into the acceptable region.

Figure 4:
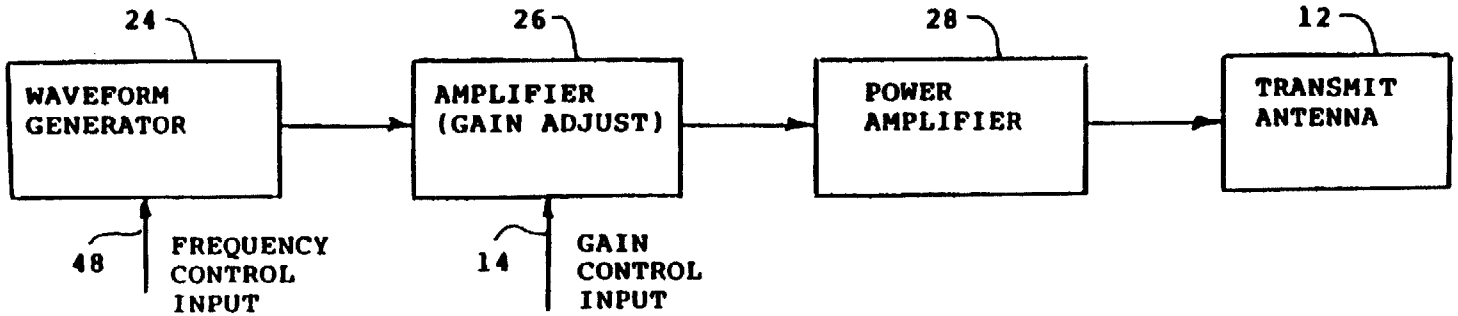
FIG. 4 is a block diagram representation of an embodiment of the invention in which both frequency and amplitude are varied.

Another possible use of the invention is shown in FIG. 4. In this case a control input 48 has been added. This allows for the variation of the frequency of the waveform generator as well as the amplitude of the transmitted field. In both cases, the control signal is generated in the receiver circuit by monitoring defining characteristics of the marker signal.

While two embodiments of this invention have been illustrated in the accompanying drawing sand described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. For detecting the presence of a marker having low coercivity and high permeability, an electronic article-surveillance apparatus comprising:

a transmitting circuit;

a transmit antenna coupled to said transmitting circuit;

a receiving antenna in operative juxtaposition with respect to the transmit antenna, whereby the transmit antenna under the control of the transmitting circuit can generate, within a controlled area, an electromagnetic signal which is received by the receiving antenna, such that when the marker is located within said controlled area, a disturbance is created in said electromagnetic signal and is picked up by the receiving antenna, the disturbance being the marker signal;

an electronics module receiving the electromagnetic signal picked up by the receiving antenna;

a feedback conduit linking the electronics module with the transmitting circuit, by which the electronics module can provide an input to the transmitting circuit which controls the amplitude of said electromagnetic signal in such a way as to maintain the marker signal at a substantially constant amplitude and shape;

a detection module connected so as to receive said marker signal, said detection module being adapted to analyze the marker signal in accordance with predetermined criteria;

and an alarm circuit connected so as to be actuated by said detection module when the detection module confirms the presence of the marker signal in accordance with said predetermined criteria.

2. The apparatus claimed in claim 1, in which said transmitting circuit includes:

a waveform generator, a gain adjust amplifier connected so as to receive a waveform signal from said waveform generator, the gain adjust amplifier being further connected so as to receive said input from said electronics module;

and a power amplifier receiving the output from said gain adjust amplifier;

the power amplifier driving said transmit antenna.

3. The apparatus claimed in claim 2, in which the waveform generator generates a sine wave.

4. The apparatus claimed in claim 2, in which said electronics module comprises: a monitor circuit adapted to monitor selected components of the marker signal, and a comparator which receives the components and compares them to a reference signal, such that nay error is used in the generation of said input to the transmitting circuit; and in which said detection module includes: a detection circuit which receives the output of the receiving antenna, the detection circuit being adapted to isolate and measure desired characteristics of the marker signal, and an analysis circuit receiving information from the detection circuit, the analysis circuit activating said alarm circuit if predetermined marker signal characteristics are present.

5. The apparatus claimed in claim 4, in which the waveform generator generates a sine wave.

6. The apparatus claimed in claim 2, in which said waveform generator receives a frequency control input, the apparatus including means for generating said frequency control input.

7. The apparatus claimed in claim 1, in which said electronics module comprises: a monitor circuit adapted to monitor selected components of the marker signal, and a comparator which receives the components and compares them to a reference signal, such that any error is used in the generation of said input to the transmitting circuit; and in which said detection module includes: a detection circuit which receives the output of the receiving antenna, the detection circuit being adapted to isolate and measure desired characteristics of the marker signal, and an analysis circuit receiving information form the detection circuit, the analysis circuit activating said alarm circuit if predetermined marker signal characteristics are present.

8. A method for detecting the presence of a marker having low coercivity and high permeability, comprising the steps:

using a transmitting circuit to generate an electromagnetic signal, and passing said signal to a transmit antenna coupled to said transmitting circuit;

receiving said electromagnetic signal in a receiving antenna disposed in operative juxtaposition with respect to the transmit antenna, whereby when the marker is located within said controlled area, a disturbance is created in said electromagnetic signal and is picked up by the receiving antenna, the disturbance being the marker signal;

passing to an electronics module the electromagnetic signal picked up by the receiving antenna;

using a feedback conduit linking the electronics module with the transmitting circuit to provide an input to the transmitting circuit which controls the amplitude of said electromagnetic signal in such a way as to maintain the marker signal at a substantially constant amplitude and shape;

connecting a detection module to receive said marker signal, and using said detection module to analyze the marker signal in accordance with predetermined criteria;

and causing an alarm circuit to be actuated by said detection module when the detection module confirms the presence of the marker signal in accordance with said predetermined criteria.

9. The method claimed in claim 8, in which the generation of said electromagnetic signal is accomplished using a waveform generator transmitting a waveform signal to a gain adjust amplifier, the gain adjust amplifier further receiving said input form said electronics module; and using a power amplifier receiving the output from said gain adjust amplifier to drive said transmit antenna.

10. The method claimed in claim 9, in which the waveform generator generates a sine wave.

11. The method claimed in claim 9, in which said electronics module comprises: a monitor circuit adapted to monitor selected components of the marker signal, and a comparator which receives the components and compares them to a reference signal, such that nay error is used in the generation of said input to the transmitting circuit; and in which said detection module includes: a detection circuit which receives the output of the receiving antenna, the detection circuit being adapted to isolate and measure desired characteristics of the marker signal, and an analysis circuit receiving information from the detection circuit, the analysis circuit activating said alarm circuit if predetermined marker signal characteristics are present.

12. The method claimed in claim 11, in which the waveform generator generates a sine wave.

13. The apparatus claimed in claim 9, in which said waveform generator receives a frequency control input, the apparatus including means from generating said frequency control input.

14. The method claimed in claim 8, in which said electronics module comprises: a monitor circuit adapted to monitor selected components of the marker signal, and a comparator which receives the components and compares them to a reference signal, such that any error is used in the generation of said input to the transmitting circuit; and in which said detection module includes: a detection circuit which receives the output of the receiving antenna, the detection circuit being adapted to isolate and measure desired characteristics of the marker signal, and an analysis circuit receiving information from the detection circuit, the analysis circuit activating said alarm circuit if predetermined marker signal characteristics are present.

* * * * *